US006550772B1

(12) United States Patent
Streeks et al.

(10) Patent No.: US 6,550,772 B1
(45) Date of Patent: Apr. 22, 2003

(54) METHOD OF PLAYING A WAGERING GAME

(76) Inventors: Jude Austin Streeks, Gills Gap, St. Michael's, Bridgetown (BB); David Prior Watson, 135a Goldhawk Road, London W12 8EN (GB); Chen Shein Hsi, 9289 Scenic Mountain La., Las Vegas, NV (US) 89117

( * ) Notice: Subject to any disclaimer, the term of this patent is extended or adjusted under 35 U.S.C. 154(b) by 0 days.

(21) Appl. No.: 09/968,197

(22) Filed: Sep. 29, 2001

(51) Int. Cl.[7] ..... A63F 1/00
(52) U.S. Cl. ..... 273/292; 273/274
(58) Field of Search ..... 273/246, 292, 273/274; 463/12, 13

(56) References Cited

U.S. PATENT DOCUMENTS 1,463,871 A * 8/1923 Chisolm ..... 273/246
2,022,533 A * 11/1935 Blank ..... 273/246
2,062,168 A * 11/1936 Entwistle ..... 273/246
5,048,841 A * 9/1991 Manney et al. ..... 273/246
5,398,938 A * 3/1995 Money ..... 273/237
6,079,713 A * 6/2000 Paz ..... 273/292

* cited by examiner

*Primary Examiner*—Benjamin H. Layno
(74) *Attorney, Agent, or Firm*—Ted Masters

(57) ABSTRACT

A method of playing a wagering game and apparatus includes a playing area having four lanes labeled diamonds, clubs, spades, and hearts. Each of the lanes have a plurality of card-receiving stations. A player places a conventional wager upon the lane which he or she believes will be filled with cards first. The player can also place a supplemental or bonus wager. A dealer then deals cards on one or more bonus stations. The dealer next sequentially deals cards face up from the deck, and places the dealt cards on a card-receiving station of the lane which corresponds to suit of the dealt card. The first lane in which all the card-receiving stations are filled is declared the winning lane. The player wins a conventional payoff if he or she placed a conventional wager on the winning lane. The player also wins a supplemental payoff if any of the cards dealt on the bonus stations match the suit of the winning lane, and the player placed a supplemental wager.

23 Claims, 16 Drawing Sheets

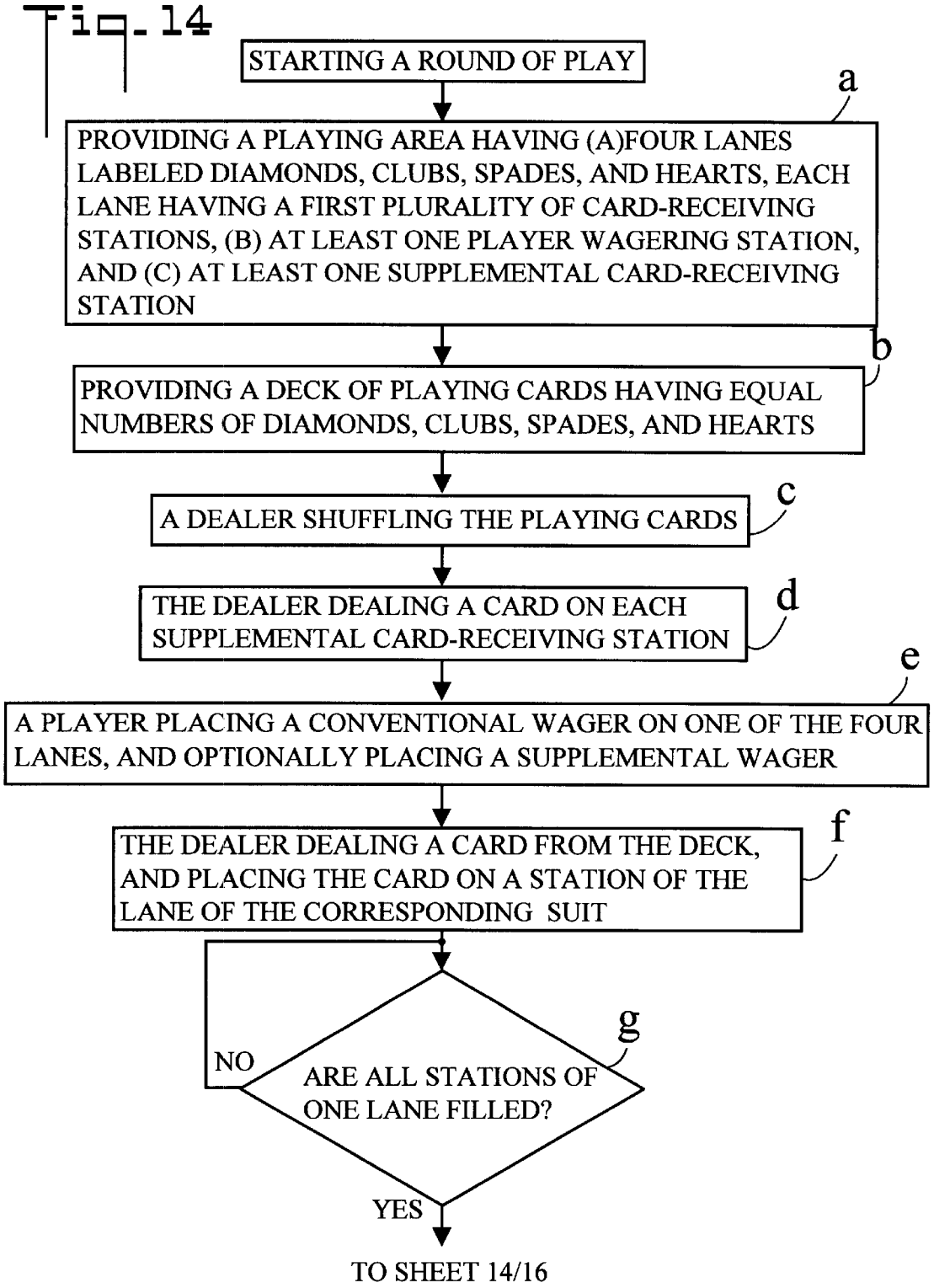
Fig. 14
STARTING A ROUND OF PLAY
a
PROVIDING A PLAYING AREA HAVING (A)FOUR LANES LABELED DIAMONDS, CLUBS, SPADES, AND HEARTS, EACH LANE HAVING A FIRST PLURALITY OF CARD-RECEIVING STATIONS, (B) AT LEAST ONE PLAYER WAGERING STATION, AND (C) AT LEAST ONE SUPPLEMENTAL CARD-RECEIVING STATION
b
PROVIDING A DECK OF PLAYING CARDS HAVING EQUAL NUMBERS OF DIAMONDS, CLUBS, SPADES, AND HEARTS
c
A DEALER SHUFFLING THE PLAYING CARDS
d
THE DEALER DEALING A CARD ON EACH SUPPLEMENTAL CARD-RECEIVING STATION
e
A PLAYER PLACING A CONVENTIONAL WAGER ON ONE OF THE FOUR LANES, AND OPTIONALLY PLACING A SUPPLEMENTAL WAGER
f
THE DEALER DEALING A CARD FROM THE DECK, AND PLACING THE CARD ON A STATION OF THE LANE OF THE CORRESPONDING SUIT
g
ARE ALL STATIONS OF ONE LANE FILLED?
NO
YES
TO SHEET 14/16

METHOD OF PLAYING A WAGERING GAME

TECHNICAL FIELD

The present invention is generally directed to wagering games, and more particularly to a wagering game wherein players wager upon a predetermined number of cards of one suit being dealt before those of the other suits.

BACKGROUND ART

Wagering games which use a deck of cards which contains the suits of diamonds, clubs, spades, and hearts are well known in the art. In a conventional single deck of playing cards, there are thirteen cards of each suit, ranging from ace through king. The deck can be used to play a myriad of wagering games.

DISCLOSURE OF INVENTION

The present invention is directed to a method of playing a wagering game, and the apparatus for playing the game. The game includes a playing area having four lanes arranged in a side-by-side racing configuration. Each lane is marked with one of the four card suits of diamonds, clubs, spades, or hearts, and has multiple partitions or stations. Players wager which lane will have it's stations filled first, when a dealer sequentially deals cards from a deck, and places the dealt card upon a station of the lane which matches the suit of the dealt card. The player receives a payoff if he or she placed a wager on the winning lane. The player can also receive a supplemental payoff. The principles of the present invention may be practiced for gambling purposes such as at a casino, or alternatively for recreation using play money. A preferred name for the present invention is BonusRun.

In accordance with a preferred embodiment of the invention, a method of playing a wagering game, includes:

(a) providing a playing area, the playing area having four side-by-side lanes, one lane labeled for each if the suits of diamonds, clubs, spades, and hearts, each of the lanes having a first plurality of card-receiving stations. The playing area also has at least one, and in a preferred embodiment, a second plurality of player wagering stations, each wagering station including (1) a conventional wagering area which allows a player to place a wager upon any of the four lanes, and (2) a supplemental wagering area. The playing area also has at least one, and in a preferred embodiment, a third plurality of supplemental card-receiving stations.

(b) providing a deck of playing cards, the deck having equal numbers of diamond cards, club cards, spade cards, and heart cards. In a preferred embodiment, a conventional deck of 52 cards is used in the present invention, however decks having other numbers of cards could also be utilized, so long as each suit has the same number of cards. Further, it may be appreciated that symbols other than diamonds, clubs, spades, and hearts could be utilized to practice the principles of the present invention.

(c) a dealer shuffling the deck of playing cards at the start of each round of play. This is an important feature of the invention, for if the cards were not shuffled before each round of play, knowledgeable players could count the cards played in a previous round of play, and thereby obtain a wagering advantage. For the same card counting reason, it would not be advisable to use a shoe of multiple decks in the present invention.

(d) the dealer dealing a card (face down in the shown embodiment) to each of the supplemental card-receiving stations. It is noted that step (d) may be performed either before or after step (g) below.

(e) a player placing a conventional wager upon one of the lanes, and the player optionally placing a supplemental wager.

(f) the dealer dealing a card face up from the deck and placing the card on a card-receiving station of the lane which corresponds to the suit of the dealt card. In a preferred embodiment, the first dealt card is placed at one end of the corresponding lanes, with subsequent dealt cards placed in the next available adjacent card-receiving station. In this fashion the appearance of a race is achieved, wherein the cards placed in the winning lane cross a finish or win line first.

(g) repeating step (f) by dealing subsequent cards until all the card-receiving stations of one lane are filled. The lane that is first filled is designated the winning lane.

(h) the player receiving a conventional payoff if the player's conventional wager was placed on the lane whose card-receiving stations were filled in step (g); and, (i) the player receiving a supplemental payoff if the suit of any of the cards in the supplemental card-receiving stations match the suit of the lane filled in step (g), and the player placed a supplemental wager. in step (e).

In accordance with another preferred embodiment of the invention, indicia representing the playing area of the present invention can be disposed on any of a casino gaming table, a game board such as those which fold in half, a playing cloth, a video game, a playstation, a bar top game, a slot machine, a TV set, a computer monitor, a lottery scratch ticket, and a portable hand held game.

In accordance with an important aspect of the invention, there are five card-receiving stations in each lane.

In accordance with an important feature of the invention, there are seven player wagering stations.

In accordance with another important aspect of the invention, there are five supplemental card-receiving stations.

In accordance with another important feature of the invention, a player is only allowed to place a wager on one lane.

In accordance with another important aspect of the invention, the amount of the conventional payoff is a function of a margin of victory of the winning lane.

In accordance with another important feature of the invention, the amount of the supplemental payoff is a function of the number of cards in the supplemental card-receiving stations which match the suit of the winning lane.

Other features and advantages of the present invention will become apparent from the following detailed description, taken in conjunction with the accompanying drawings, which illustrate, by way of example, the principles of the invention.

MODES FOR CARRYING OUT THE INVENTION

Figure 1:
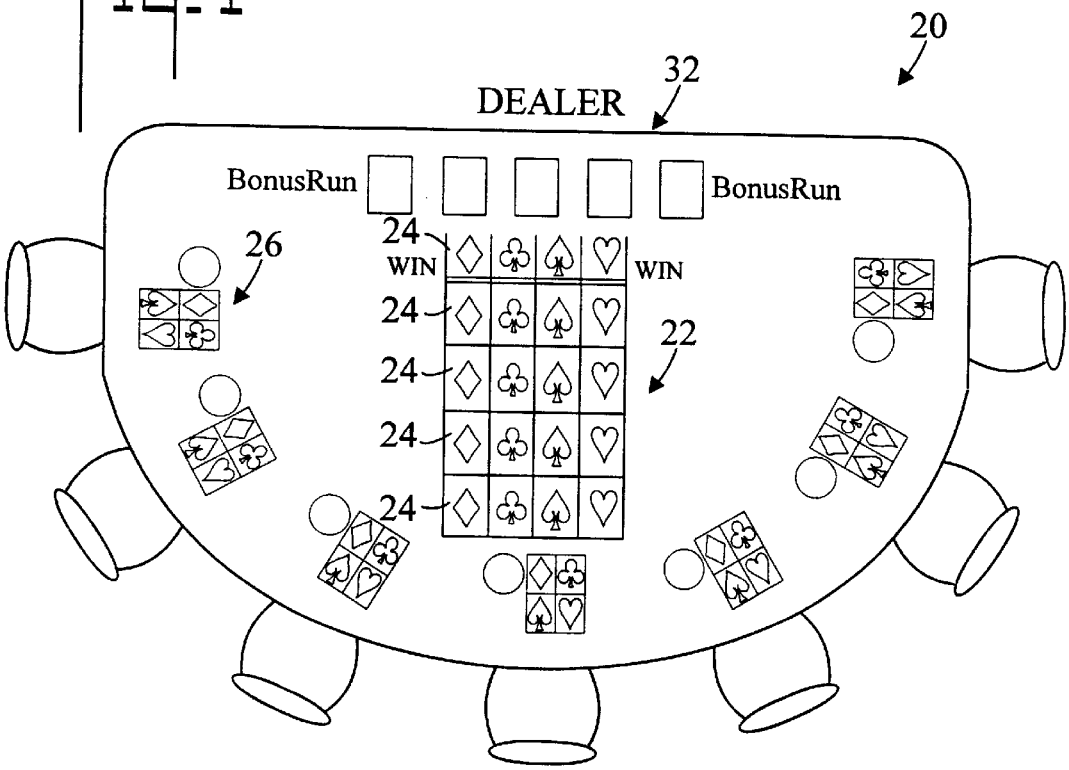
FIG. 1 is a plan view of a playing area in accordance with the present invention.

Referring initially to FIG. 1, there is illustrated a plan view of a playing area in accordance with the present invention, generally designated as 20. In the shown embodiment, playing area is disposed on a casino gaming table. Playing area 20 includes four side-by-side lanes 22, one lane 22 each labeled with the suits of diamonds (22*a*), clubs (22*b*), spades (22*c*), and hearts (22*d*). Each lane 22 is partitioned into a first plurality of card-receiving stations 24, five in the shown preferred embodiment. Playing area 20 includes at least one player wagering station 26, and in the shown preferred embodiment a second plurality of player wagering stations 26. Each player wagering station 26 includes a conventional wagering area 28 for the four lanes 22 of diamonds, clubs, spades, and hearts, and also a supplemental wagering area 30 (refer also to FIG. 2). In the shown preferred embodiment, there are seven player wagering stations 26 which accommodate seven players. Playing area 20 also includes at least one supplemental card-receiving station 32, and in the shown preferred embodiment a third plurality of supplemental card-receiving stations 32 (also refer to FIG. 3). In the shown preferred embodiment, there are five supplemental card-receiving stations 32.

Figure 2:
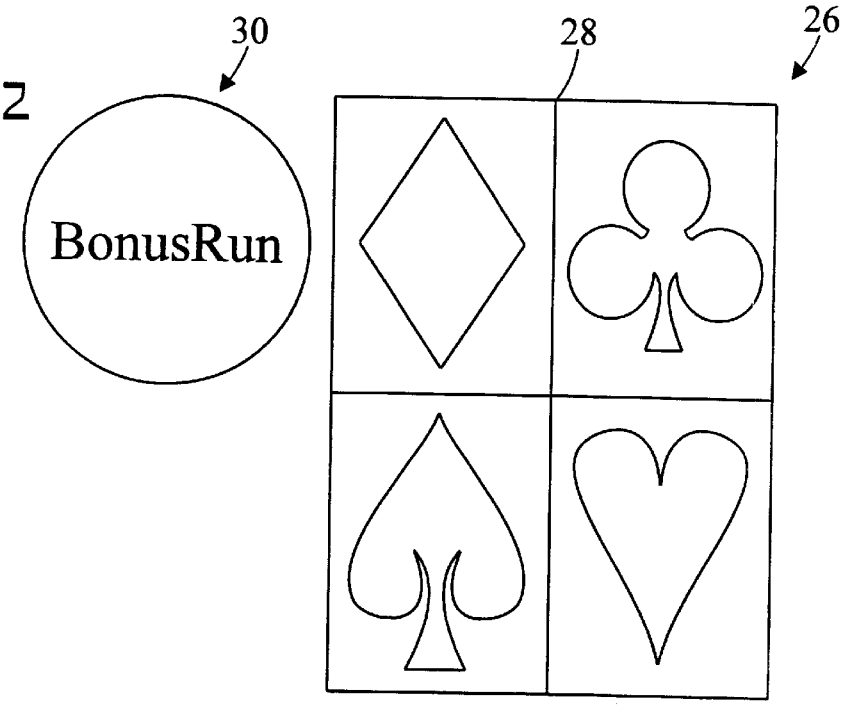
FIG. 2 is an enlarged view of a player wagering station.

FIG. 2 is an enlarged view of player wagering station 26.

Figure 3:
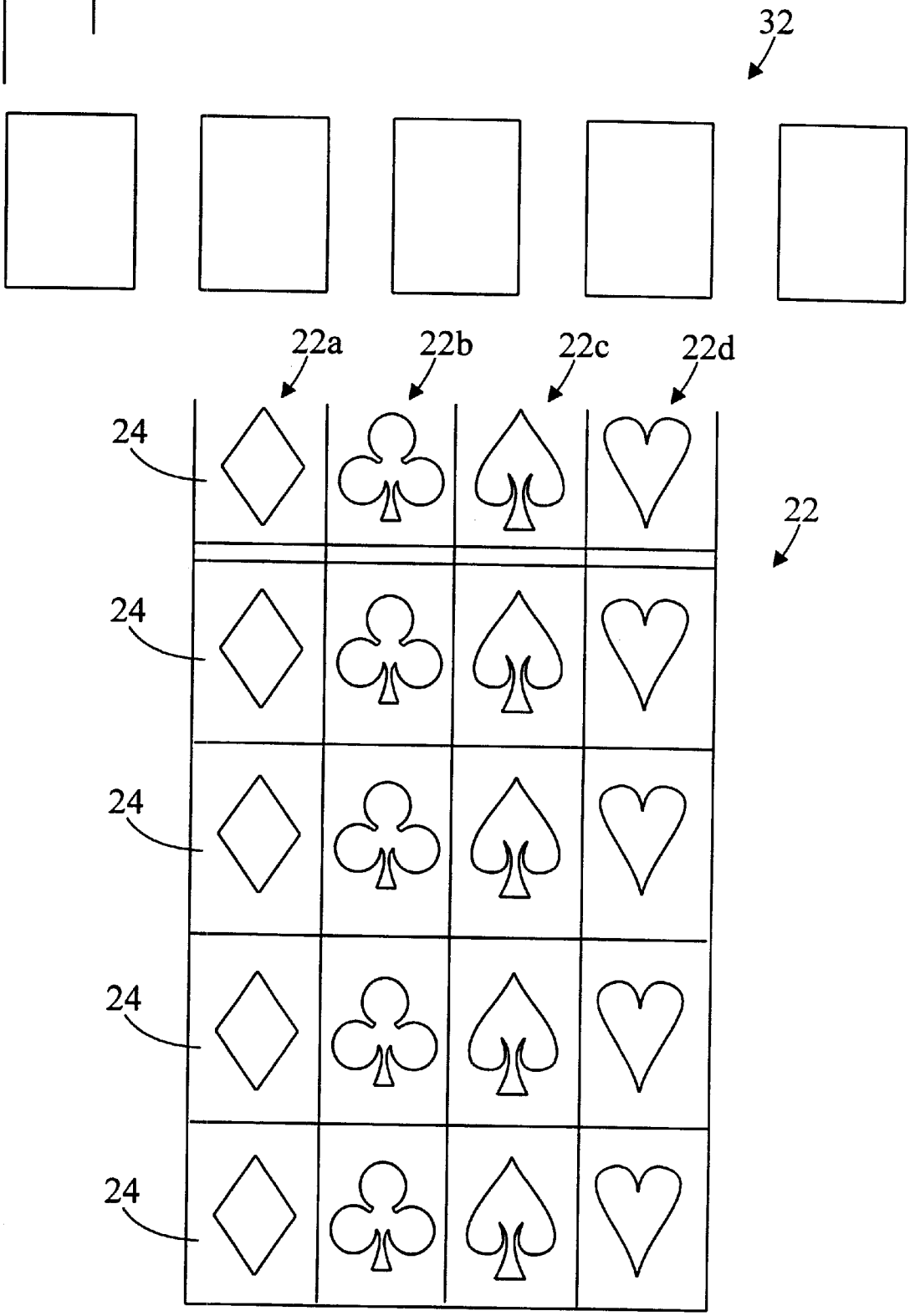
FIG. 3 is an enlarged view of supplemental card-receiving stations, and four lanes presenting the suits of diamonds, clubs, spades, and hearts.

FIG. 3 is an enlarged view of supplemental card-receiving stations 32, and four lanes 22 representing the suits of diamonds, clubs, spades, and hearts.

The wagering game of the present invention is preferably played with a deck of conventional playing cards, however specialized decks could also be utilized. A player places a conventional wager (two chips in the shown embodiment) on the lane (suit) 22 which he or she believes will be filled with cards first. It is appreciated that more than one player can place wagers upon the same lane (suit) 22. Additionally, the player may optionally place a supplemental, or bonus wager (one chip in the shown embodiment). A dealer then deals five cards face down in each of the supplemental card-receiving stations 32. Then the dealer sequentially deals cards from the deck and places the dealt cards in the lane 22 which corresponds to the suit of the dealt card. This process continues until one of the lanes 22 is filled with cards, five in the shown embodiment. The lane 22 which first receives five cards is declared the winner. If a player has placed a conventional wager upon the winning lane 22, then the player receives a conventional payoff. The amount of the conventional payoff is proportional to the margin by which the winning lane 22 wins. For example, if the next highest number of cards in any losing lane 22 was three, then the margin victory would be two (five minus three). If the player places his or her conventional wager upon a lane 22 other than the winning lane 22, then the player loses both the conventional wager and the supplemental wager if placed.

Additionally, after one lane 22 is declared the winner, all of the cards in the supplemental card-receiving stations 32 are exposed. If the player has also placed a supplemental wager, the player also receives a supplemental payoff which is proportional to the number of cards of the winning suit which are in the supplemental card-receiving stations 32. If the player does not place a supplemental wager, then he or she receives no supplemental payoff, even if the player placed a conventional wager upon the winning lane 22.

Figure 4:
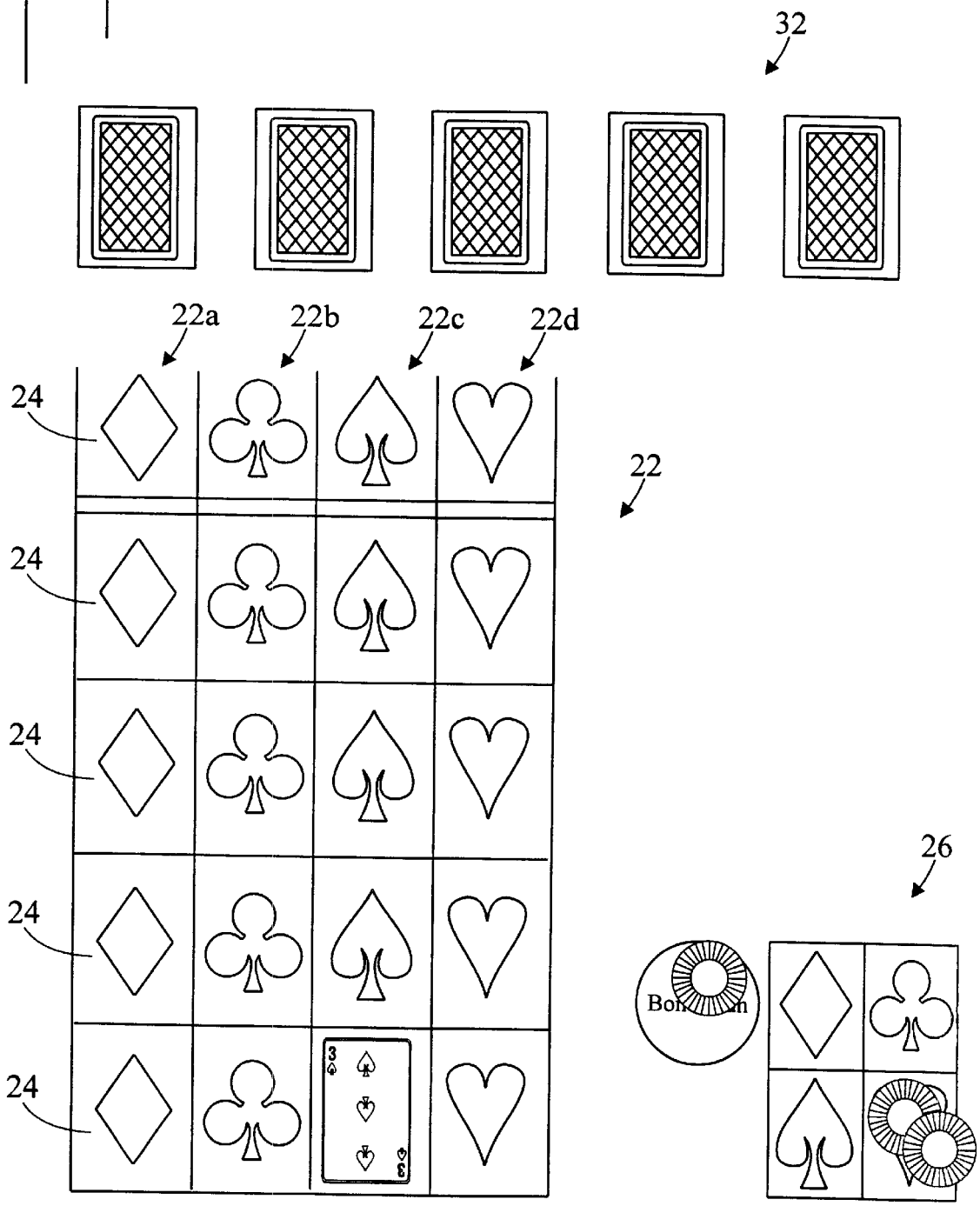
FIG. 4 is an enlarged view of a first playing situation.

FIG. 4 is an enlarged view of a first playing situation, showing supplemental card-receiving stations 32, four lanes 22*a* through 22*d*, and player wagering station 26 for one player. The player has placed a two chip conventional wager on hearts lane 22*d*, and has also placed a one chip supplemental wager. Five cards have been placed face down on the supplemental card-receiving stations 32. A dealer has dealt a first card face up from the deck, the 3 of spades, and placed the 3 of spades in the lowest card-receiving station 24 of spade lane 22*c*. It is noted that the first card is placed at the lowest position of the lane 22, and subsequent cards are placed adjacent to the last placed card until a win or finish line is crossed.

Figure 5:
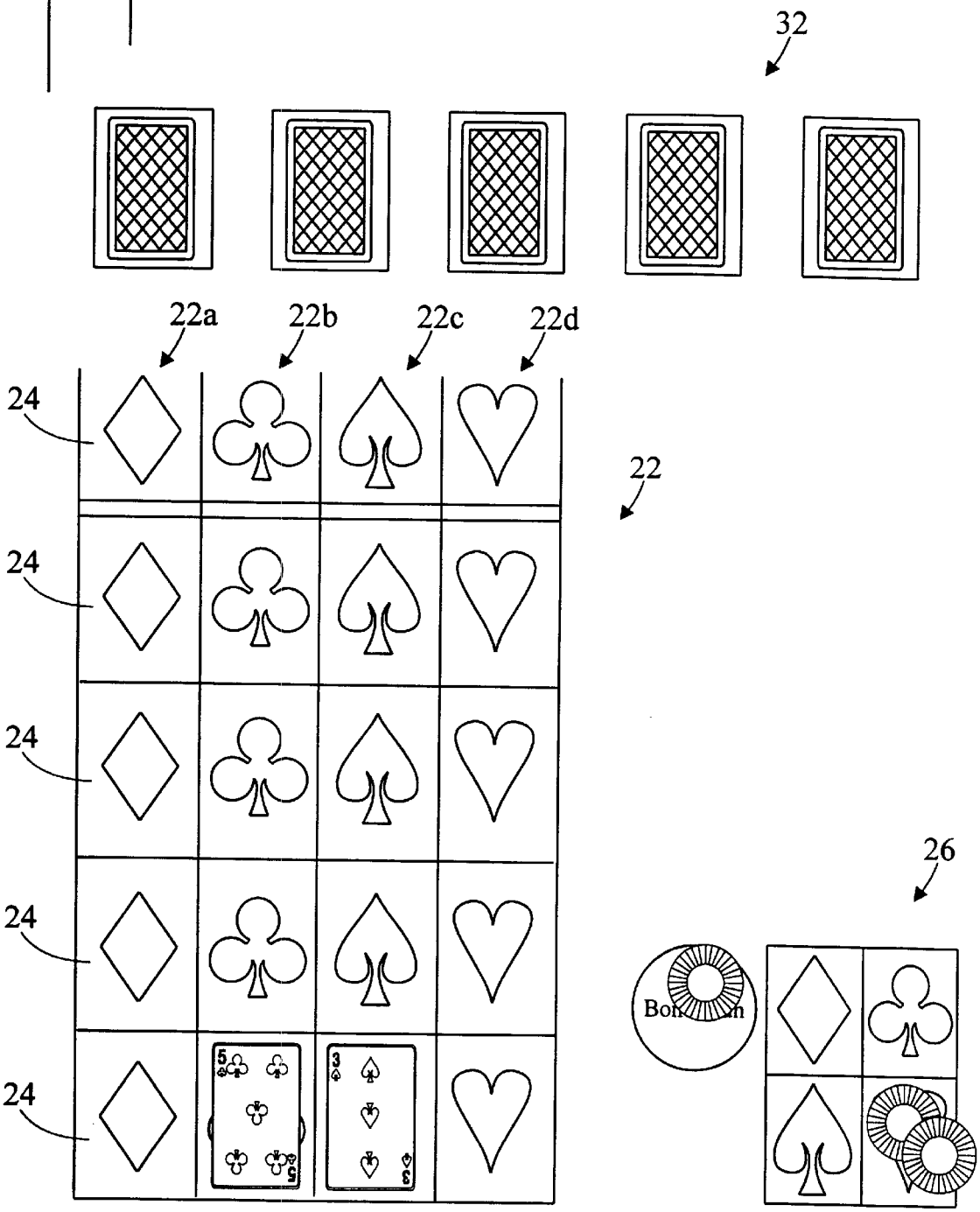
FIG. 5 is an enlarged view after a second card has been placed face up on a lane.

FIG. 5 is an enlarged view after a second card, the 5 of clubs, has been dealt from the deck and placed face up on club lane 22*b*.

Figure 6:
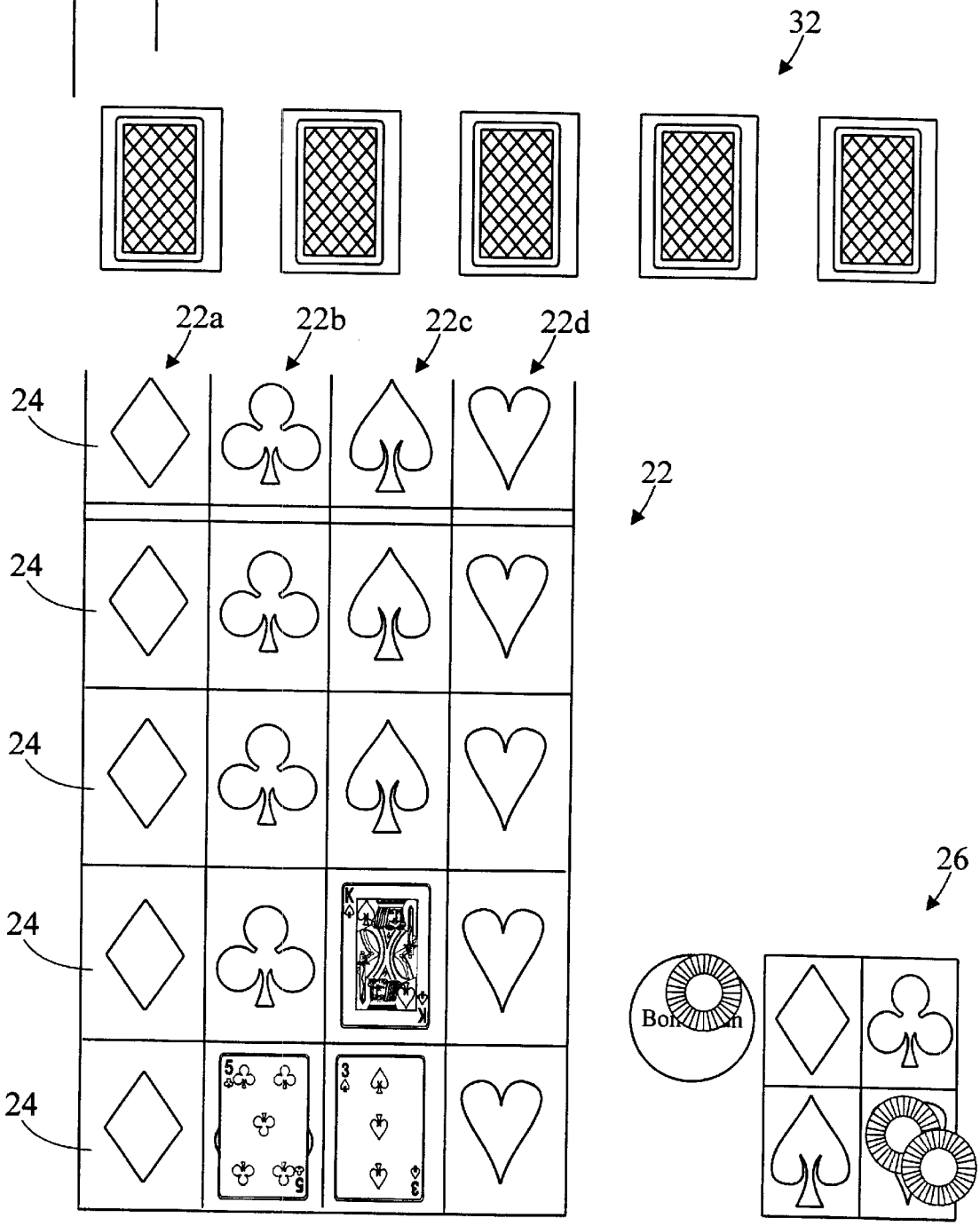
FIG. 6 is an enlarged view after a third card has been placed face up on a lane.

FIG. 6 is an enlarged view after a third card, the King of spades, has been dealt from the deck and placed face up in the second position of spade lane 22*c*. Dealing and placing on the lane 22 which corresponds to the dealt card continues in this fashion.

Figure 7:
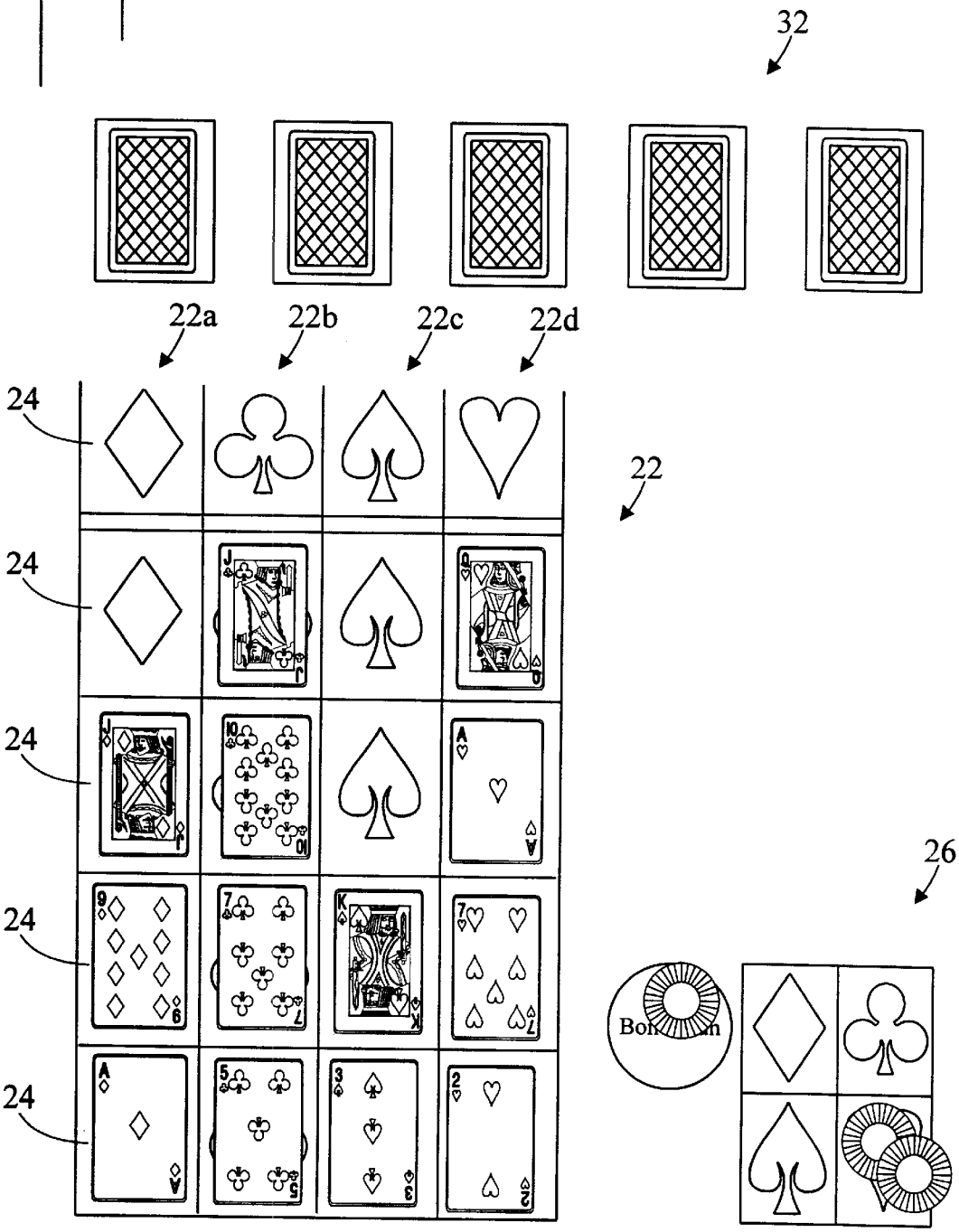
FIG. 7 is an enlarged view after thirteen cards have been placed face up on lanes.

FIG. 7 is an enlarged view sometime later after thirteen cards have been dealt and placed face up on their respective lanes 22. It is noted that club lane 22*b* and heart lane 22*d* are ahead, each of these lanes 22 only requiring one additional card to fill all five card-receiving stations 24 and be declared the winning lane 22.

Figure 8:
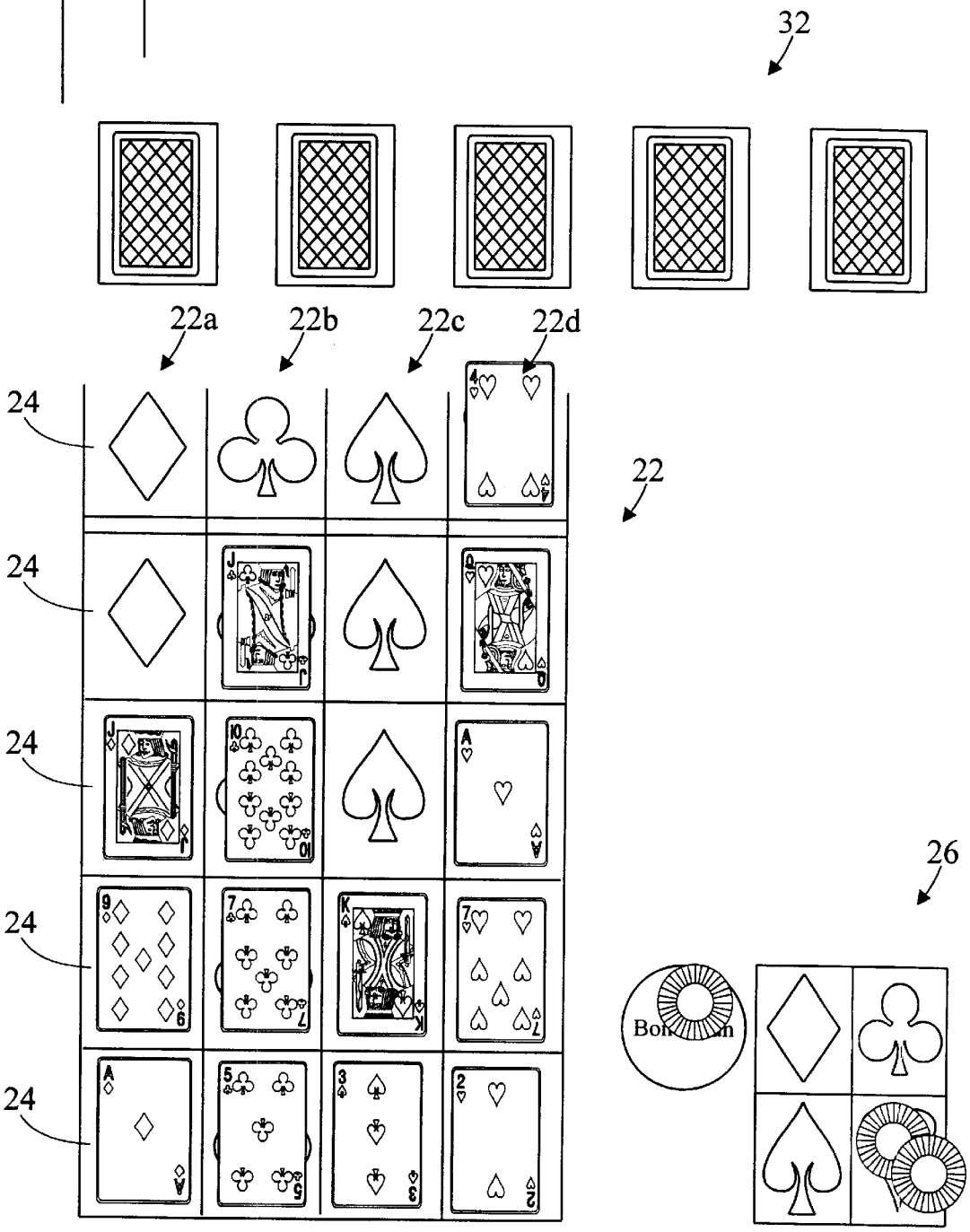
FIG. 8 is an enlarged view after fourteen cards have been placed face up on lanes, and the heart lane wins.

FIG. 8 is an enlarged view after the next card, the four of hearts, has been dealt and placed. It is noted that all five stations of heart lane 22*d* are now filled, therefore heart lane 22*d* is declared the winning lane. Since the player placed a two chip conventional wager on the heart lane 22*d*, the player wins a conventional payoff. The amount of the conventional payoff is proportional to the margin of victory of heart lane 22*d*. In this instance the margin of victory is one station 24 over club lane 22*b*. In a preferred embodiment, the amount of the conventional payoff for the conventional wager for various margins of victory is shown below:

| Margin of Victory | 1 | 2 | 3 | 4 | 5 |
|---|---|---|---|---|---|
| Payoff (times conventional wager) | 1× | 3× | 5× | 20× | 60× |

Therefore, for the shown one station 24 margin of victory, the player would receive a payoff of two chips (one times the two chip conventional wager) while keeping the chip that was originally wagered.

Figure 9:
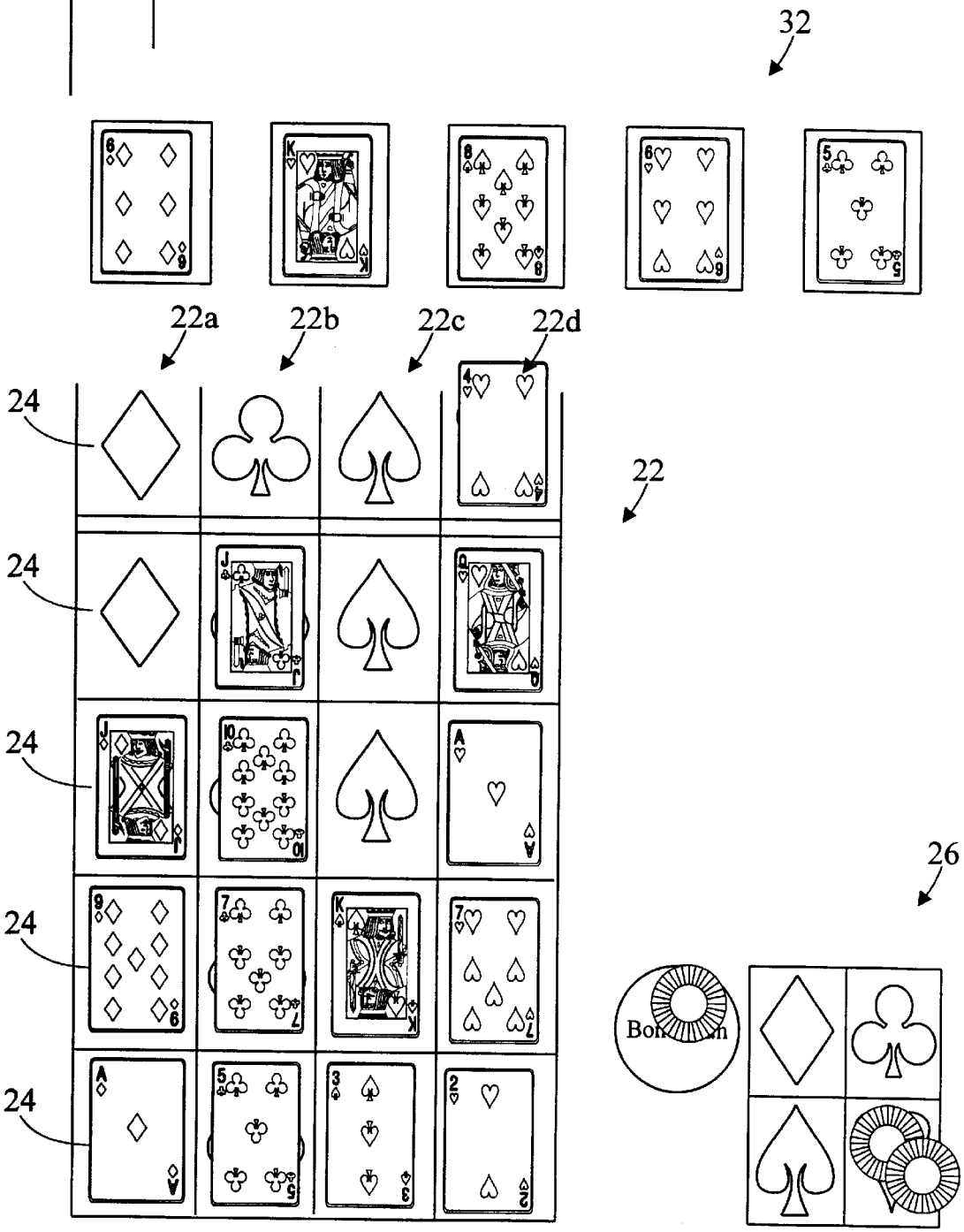
FIG. 9 is an enlarged view showing the exposure of the cards on the supplemental card-receiving stations.

FIG. 9 is an enlarged view showing the cards on the supplemental card-receiving stations 32 which have been turned over to reveal what they are. The amount of the supplemental payoff is proportional to the number of cards on the supplemental card-receiving stations 32 which match the winning lane, in this case heart lane 22*d*. It is noted that two hearts, the King and six, are on supplemental card-receiving stations 32. In a preferred embodiment, the amount of the supplemental payoff is shown below:

| Number of Matching Cards | 0 | 1 | 2 | 3 | 4 | 5 |
|---|---|---|---|---|---|---|
| Payoff (times supplemental wager) | 0* | 1× | 6× | 25× | 80× | 200× |

*if no cards match the winning lane, the player loses his or her supplemental wager Therefore, for having two matching cards, the player would receive a payoff of six chips (six times the supplemental wager of one chip), while keeping the chip that was originally wagered.

It may be appreciated that other conventional and supplemental payoff amounts could also be utilized.

Figure 10:
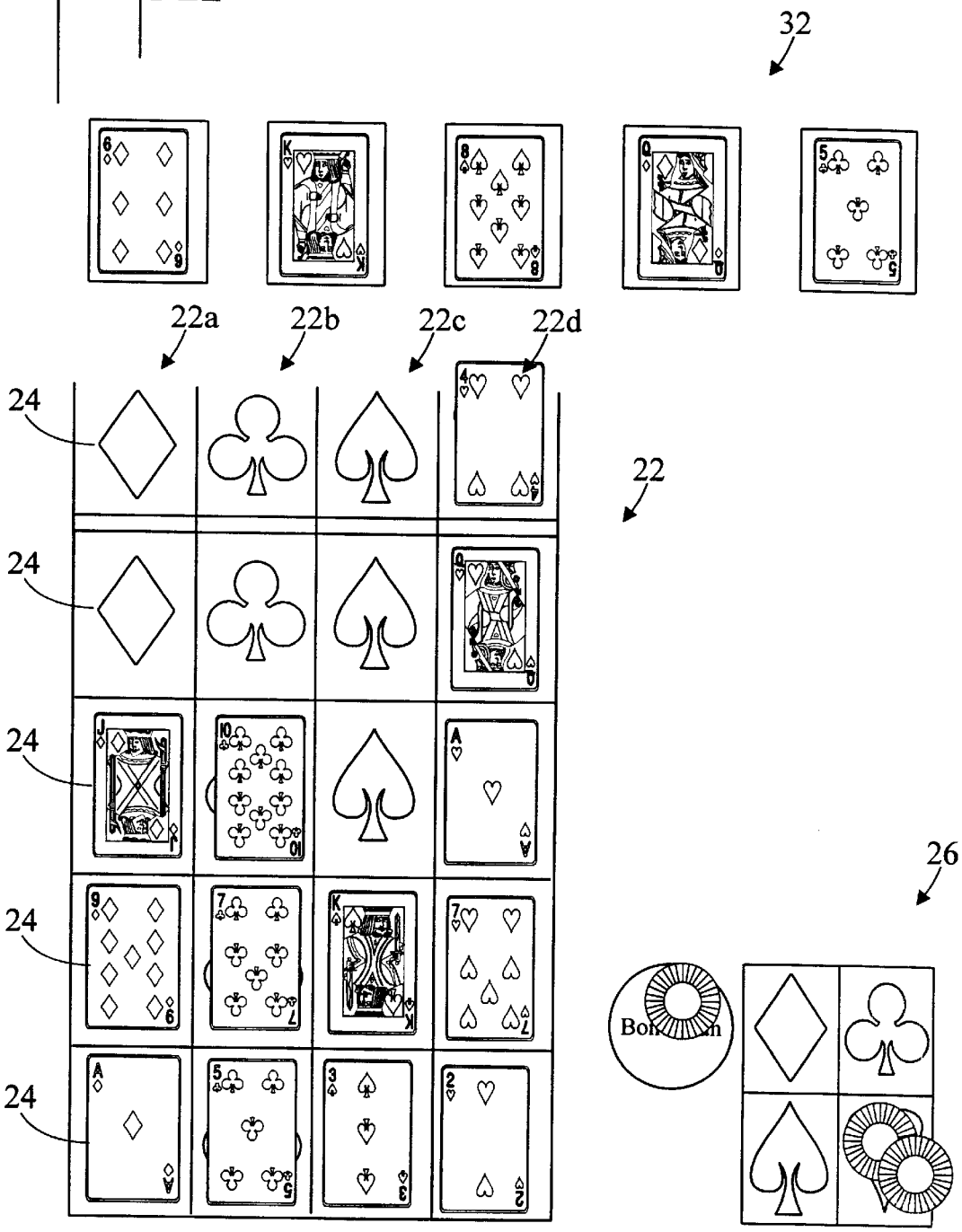
FIG. 10 is an enlarged view of a second playing situation.

FIG. 10 is an enlarged view of a second playing situation. Second playing situation is similar to the first playing situation of FIG. 9, except that the margin of victory of heart lane 22*d* is two stations 24 over diamond lane 22*a* and club lane 22*b*. Therefore the conventional payoff would be six chips (three times the player's two chip wager). Also only one heart, the King, is in the supplemental card-receiving stations 32. Therefore, the supplemental payoff is only one chip (one times the player's one chip wager).

Figure 11:
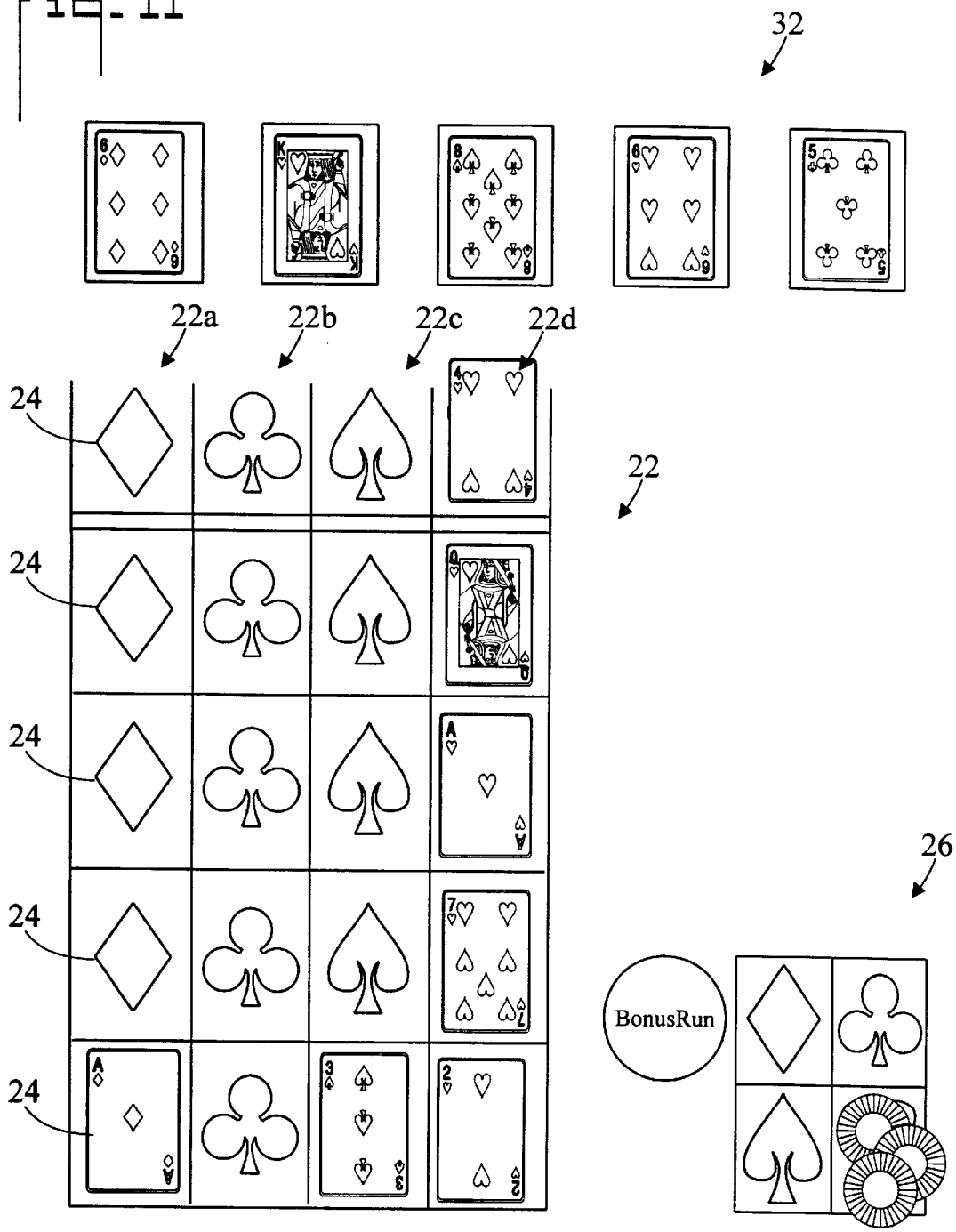
FIG. 11 is an enlarged view of a third playing situation.

FIG. 11 is an enlarged view of a third playing situation. Here the margin of victory is four stations 24, therefore the conventional payoff is 60 chips (twenty times the wager of three chips), and the player does not receive a supplemental payoff since he or she did not place a supplemental wager.

Figure 12:
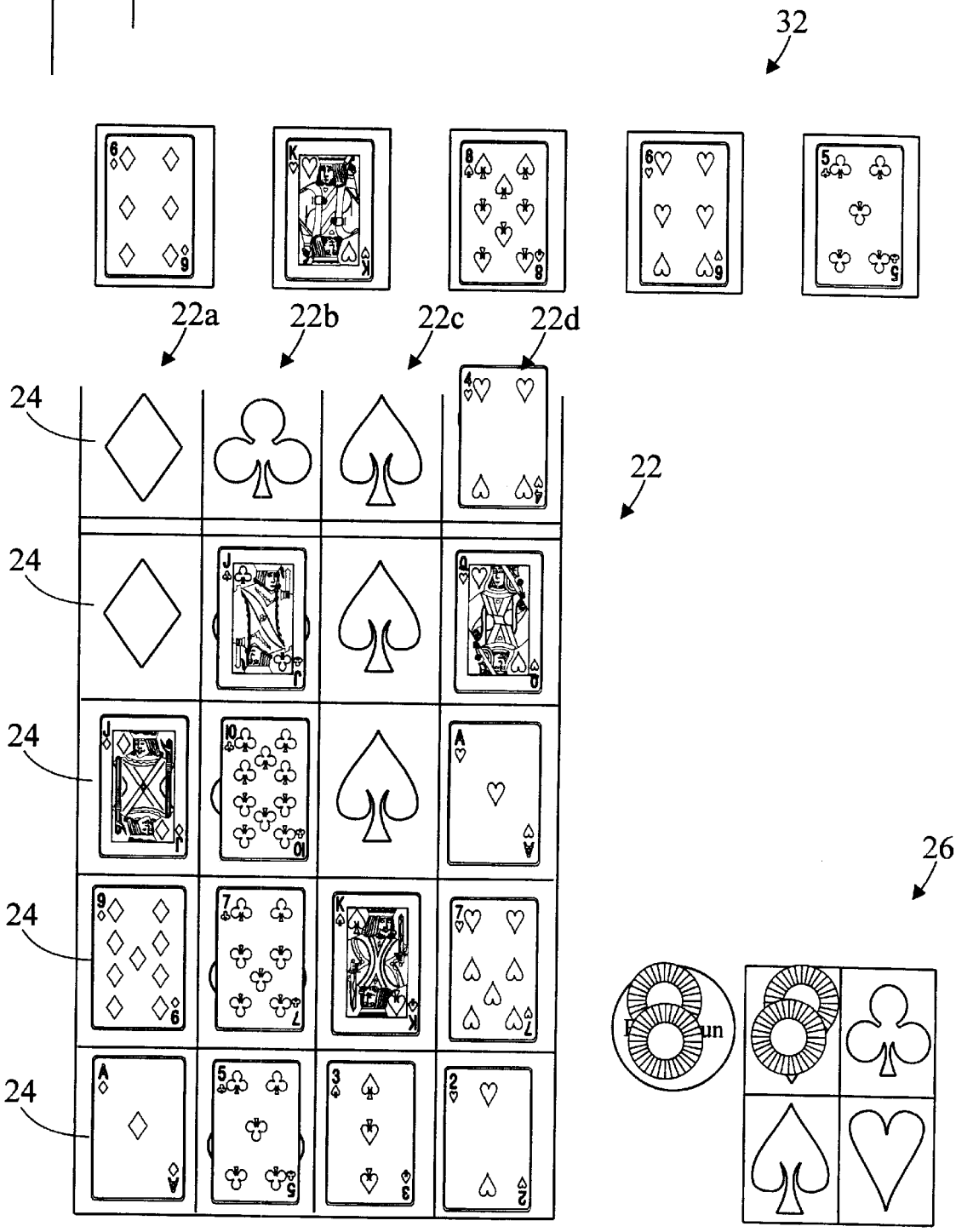
FIG. 12 is an enlarged view of a fourth playing situation.

FIG. 12 is an enlarged view of a fourth playing situation. Here, since the diamond lane 22*d* did not win, the player loses both the conventional wager and the supplemental wager.

Figure 13:
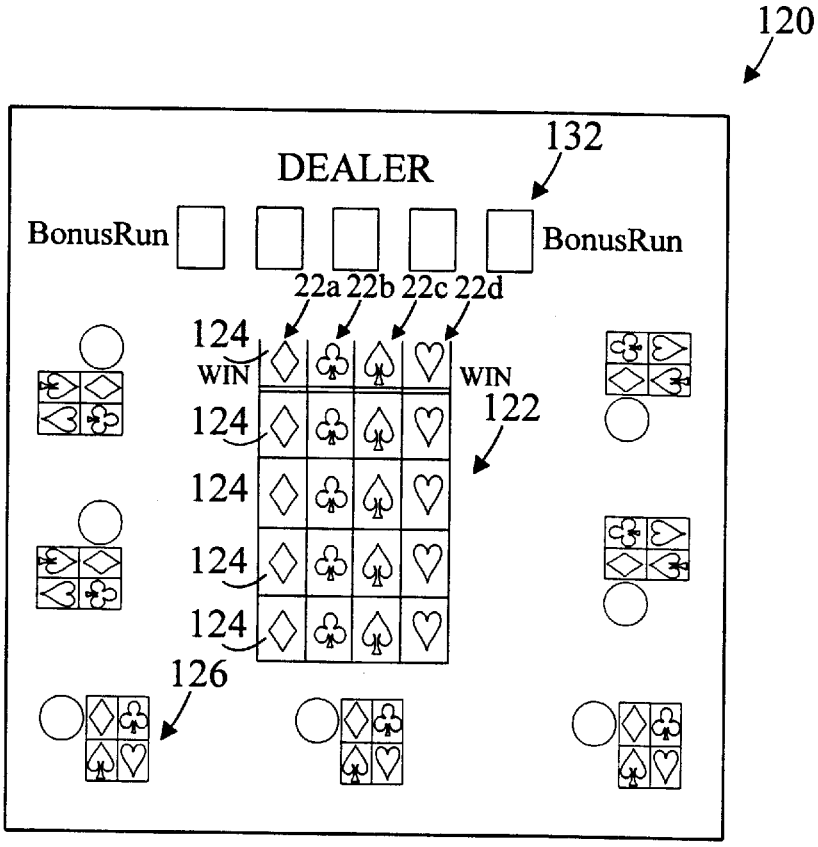
FIG. 13 is a plan view of a game board embodiment of the present invention.

FIG. 13 is a plan view of a game board embodiment of the present invention having a playing area generally designated as 120. Game board embodiment 120 would be suitable for use as either a gambling game, or as a non-gambling game in a home playing environment. The game board has a playing area 120 which includes indicia depicting:

four lanes 122, one lane 122*a* labeled with the suit of diamonds, one lane 122*b* labeled with the suit of clubs, one lane 122*c* labeled with the suit of spades, and one lane 122*d* labeled with the suit of hearts, each lane 122 including a first plurality of card-receiving stations 124;

a second plurality of player wagering stations 126, each wagering station 126 including (1) a wagering area 128 for the four lanes 122, and (2) a supplemental wagering area 130; and, a third plurality of supplemental card-receiving stations 132.

The game board embodiment can further include a deck of playing cards, the deck having equal numbers of diamond cards, club cards, spade cards, and heart cards.

It may further be appreciated that the principles of the present invention could also be practiced in a representation of a playing area which is disposed upon any of a casino gaming table, a game board, a playing cloth, a video game, a playstation, a bar top game, a slot machine, a TV set, a computer monitor (such as for playing a software or internet embodiment of the present invention), a lottery scratch ticket, and a portable hand held game.

Figure 14:
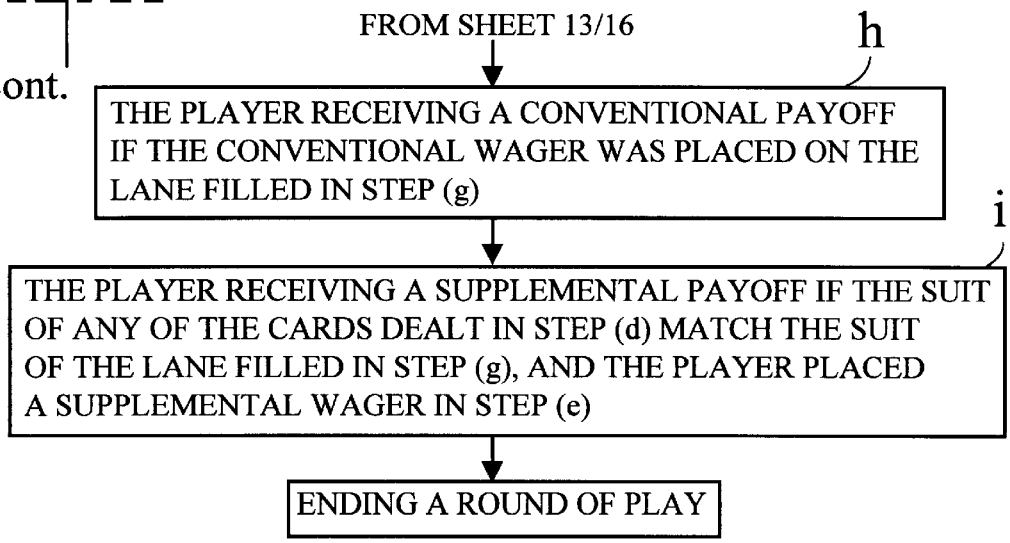
FIG. 14 is a flow chart illustrating the method of the present invention; and, FIG. 15 is a second flow chart illustrating the method of the present invention.

FIG. 14 is a flow chart illustrating the method of the present invention.

In step (a), a playing area 20 is provided. The playing area 20 may be disposed on any of a casino gaming table (the shown embodiment), a game board, a playing cloth, a video game, a playstation, a bar top game, a slot machine, a TV set, a computer monitor, a lottery scratch ticket, and a portable hand held game. The playing area includes:

four lanes 22, one lane 22*a* labeled with the suit of diamonds, one lane 22*b* labeled with the suit of clubs, one lane 22*c* labeled with the suit of spades, and one lane 22*d* labeled with the suit of hearts, each lane 22 including a first plurality of card-receiving stations 24;

at least one player wagering station 26, and in a preferred embodiment a second plurality of player wagering stations 26, each player wagering station 26 including (1) a conventional wagering area 28 for the four lanes 22, and (2) a supplemental or bonus wagering area 30; and, at least one supplemental card-receiving station 32, and in a preferred embodiment a third plurality of supplemental card-receiving stations 32;

In the shown preferred embodiment, the first plurality of card-receiving stations 24 is five, the second plurality of player wagering stations 26 is seven, and the third plurality of supplemental card-receiving stations 32 is five. It may be appreciated that these numbers could be changed, and still be embraced by the principles of the present invention.

In step (b) a deck of playing cards is provided, the deck having equal numbers of diamond cards, club cards, spade cards, and heart cards.

In step (c) a dealer shuffles the deck of playing cards. In a preferred embodiment, step (c) must always precede steps (d), (f), and (g) so that card counting cannot be practiced by a player.

In step (d), the dealer deals a card on each supplemental card-receiving station 32 provided in step (a), five cards in the shown preferred embodiment. The cards may be dealt face down as shown, or face up, or a combination of face down and face up. If the cards are dealt face down, step (i) includes the process of revealing the cards dealt in step (d). Also, step (d) may be performed before step (g) below as show, or step (d) may be performed after step (g), or a mix of before and after step (g) (e.g. some cards dealt before step (g), and other cards dealt after step (g)).

In step (e), a player places a conventional wager upon one of the lanes (suits) 22, and the player optionally placing a supplemental or bonus wager. In a preferred embodiment of the invention, the player is only permitted to place a conventional wager upon one of the lanes 22. For example, in a round of play, the player can not place wagers upon two lanes 22, three lanes 22, or upon all four lanes 22.

In step (f), the dealer deals a card face up from the deck and places the card on a card-receiving station 24 of the lane 22 which corresponds to the suit of the dealt card.

In step (g), step (f) is repeated until all card-receiving stations 24 of one lane 22 are filled. In other words, after a card is dealt and placed in step (f), it is observed whether any of the lanes 22 have all of their card-receiving stations 24 filled. If no, step (f) is repeated. If yes, the dealing stops and the lane 22 which is filled is declared the winning lane 22.

In step (h), the player receives a conventional payoff if the conventional wager was placed on the lane 22 whose card-receiving stations 24 were filled in step (g). In a preferred embodiment, the amount of the conventional payoff is a function of a margin of victory of the lane 22 which is filled in step (g). For example, if the next highest number of card-receiving stations 24 in any other lane 22 is two, then the margin of victory is three (five minus two).

In a preferred embodiment, before step (h), the difference between the first plurality of card-receiving stations 24 (five in the shown embodiment) and the maximum number of card-receiving stations 24 filled in any other lane 22 is calculated. In a preferred embodiment, the conventional payoff is:

one times the conventional wager if the difference is one;

three times the conventional wager if the difference is two;

five times the conventional wager if the difference is three;

20 times the conventional wager if the difference is four;

60 times the conventional wager if the difference is five.

It may be appreciated that other conventional payoff amounts could also apply, and still be embraced within the principles of the present invention.

In step (i), the player receives a supplemental payoff if the suit of any card dealt in step (d) matches the suit of the lane 22 filled in step (g), and the player placed a supplemental wager in step (e). If the cards were dealt face down in step (d), then step (i) also includes revealing the cards dealt in step (d). In a preferred embodiment, the amount of the supplemental payoff is a function of the number of cards in supplemental card-receiving stations 32 which match the suit of the lane 22 filled in step (g). In a preferred embodiment, wherein there are five supplemental card-receiving stations, the supplemental payoff is:

none, if no cards in the supplemental card-receiving stations match the suit of the lane 22 filled in step (g);

one times the supplemental wager, if one card in the supplemental card-receiving stations matches the suit of the lane 22 filled in step (g);

six times the supplemental wager, if two cards in the supplemental card-receiving stations match the suit of the lane 22 filled in step (g);

25 times the supplemental wager, if three cards in the supplemental card-receiving stations match the suit of the lane 22 filled in step (g);

80 times the supplemental wager, if four cards in the supplemental card-receiving stations match the suit of the lane 22 filled in step (g); and, 200 times the supplemental wager, if five cards in the supplemental card-receiving stations match the suit of the lane 22 filled in step (g).

It may be appreciated that other supplemental payoff amounts could also apply, and still be embraced within the principles of the present invention.

It may also be appreciated that the principles of the present invention may be practiced with any number of lanes 22 (except one), wherein each lane 22 is labeled with a different symbol. Therefore, in a more generalized embodiment of the present invention, a method of playing a wagering game, includes:

(a) providing a playing area, the playing area including;
a plurality of lanes 22, each lane 22 being labeled with a different symbol, each lane 22 including a first plurality of card-receiving stations 24;
at least one player wagering station 26, the at least one player wagering station 26 including (1) a conventional wagering area 28, and (2) a supplemental wagering area 30; and,
at least one supplemental card-receiving station 32;

(b) providing a deck of playing cards, the deck having equal numbers of cards having each of the symbols provided in step (a);

(c) a dealer shuffling the deck of playing cards;

(d) the dealer dealing a card on each supplemental card-receiving station 32 of step (a);

(e) a player placing a conventional wager upon one of the lanes 22, and the player optionally placing a supplemental wager;

(f) the dealer dealing a card face up from the deck and placing the card on a card-receiving station 24 of the lane 22 which corresponds to the symbol of the dealt card;

(g) repeating step (f) until all the card-receiving stations 24 of one lane 22 are filled;

(h) the player receiving a conventional payoff if the conventional wager was placed on the lane 22 whose card-receiving stations 24 were filled in step (g); and, (i) the player receiving a supplemental payoff if the symbol of any dealt in step (d) matches the symbol of the lane 22 filled in step (g), and the player placed a supplemental wager in step (e).

Figure 15:
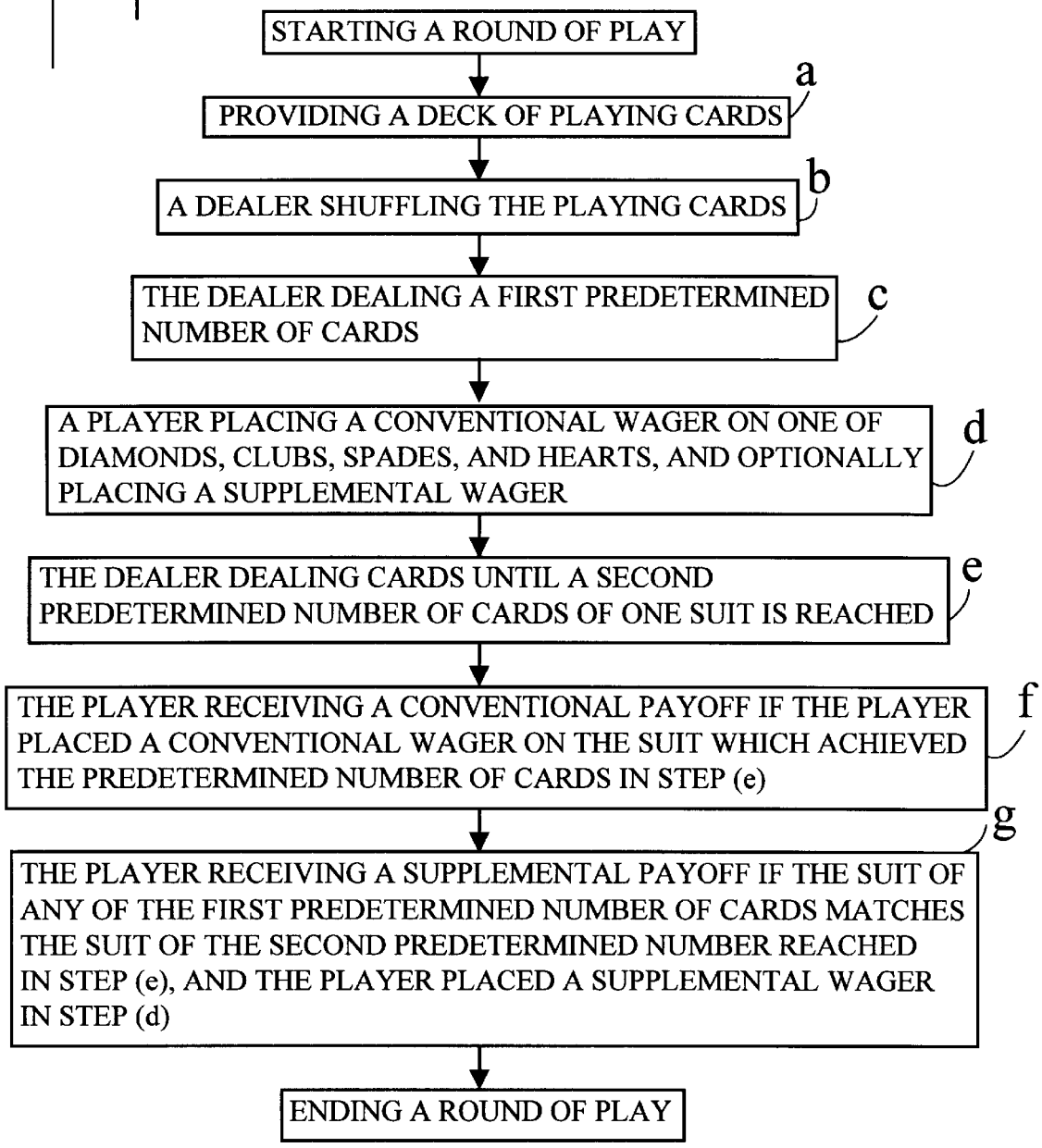

FIG. 15 is a second flow chart illustrating the method of the present invention.

In step (a), a deck of playing cards is provided, the deck having equal numbers of diamond cards, club cards, spade cards, and heart cards.

In step (b), a dealer shuffles the deck of playing cards.

In step (c), the dealer deals a first predetermined number of cards. In a preferred embodiment, the first predetermined number of cards is five, and the cards are dealt face down.

In step (d), a player places a conventional wager upon one of (1) the suit of diamonds, (2) the suit of clubs, (3) the suit of spades, and (4) the suit of hearts, and the player optionally placing a supplemental wager. In a preferred embodiment of the invention, the player is only permitted to place a conventional wager upon one of the suits.

In step (e), the dealer sequentially deals cards from the deck (face up) until a second predetermined number of cards of any of the suits of diamonds, clubs, spades, and hearts is reached. In a preferred embodiment, the second predetermined number of cards is five.

In step (f), the player receives a conventional payoff if the conventional wager was placed on the suit where the second predetermined number was reached in step (e). In a preferred embodiment, the amount of the conventional payoff is a function of a margin of victory of the suit where the second predetermined number was reached in step (e).

In step (g), the player receives a supplemental payoff if the suit of any of the first predetermined number of cards match the suit where the second predetermined number was reached in step (e), and the player placed a supplemental wager in step (d). In a preferred embodiment, the amount of the supplemental payoff is a function of the number of the second predetermined number of cards which match the suit where the second predetermined number was reached in step (e).

It may be appreciated that while the forgoing description has focused upon the wagers and winnings of one player, it may be appreciated that a plurality of players may simultaneously participate in the wagering game of the present invention. In such instances, in a round of play after the winning lane 22 has been determined, and the cards of supplemental card-receiving stations 32 have been exposed, the dealer sequentially settles wagers with each of the players.

Figure 16:
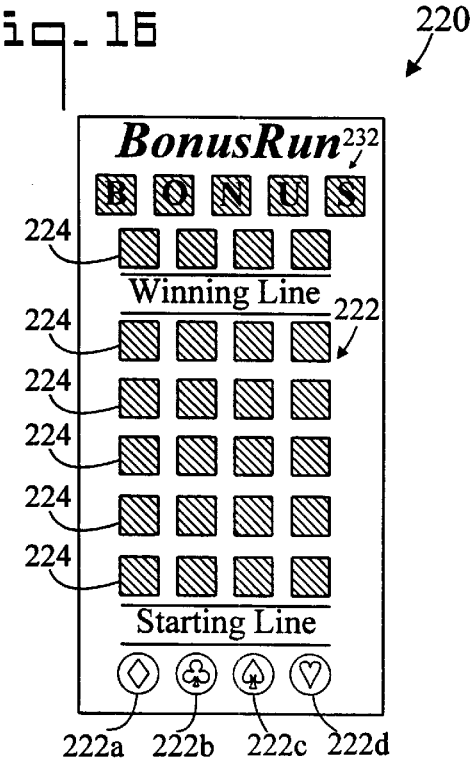
FIG. 16 is a plan view of a scratch lottery ticket embodiment of the present invention.
Figure 17:
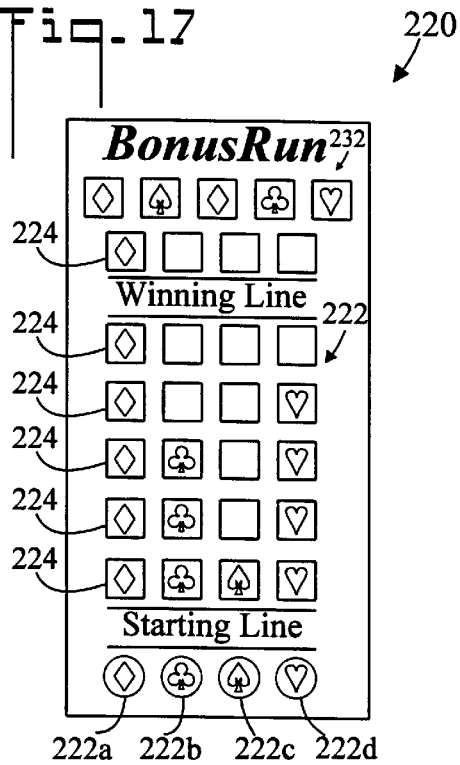
FIG. 17 is a plan view of the scratch lottery ticket embodiment of FIG. 16 with the opaque coating removed; and, FIG. 18 is a plan view of a second scratch lottery ticket embodiment wherein a player is only permitted to remove the opaque coating from one of the lanes.

FIG. 16 is a plan view of a scratch lottery ticket embodiment of the present invention, generally designated as 220. Apparatus for playing a lottery game, includes:

a lottery scratch ticket having a playing area 220, the playing area 220 including:

a plurality of lanes 222, each lane being labeled with a different symbol. In the shown preferred embodiment there are four lanes 222, one lane 222*a* labeled with the suit of diamonds, one lane 222*b* labeled with the suit of clubs, one lane 222*c* labeled with the suit of spades, and one lane 222*d* labeled with the suit of hearts. Each lane 222 including a first plurality of stations 224, six in the shown preferred embodiment.

one lane 222, and only one lane 222, has each of its stations 224 filled with first indicia representing the suit of that one lane. Referring also to FIG. 17, it is seen that the only lane 222 with its stations 224 filed is the diamond lane 222*a*.

at least one supplemental station 332. In the shown preferred embodiment there are a plurality of supplemental stations 332 , five in the shown embodiment.

second indicia representing one of the symbols (diamonds, clubs, spades, and hearts in the shown embodiment) is disposed on the at least one supplemental station 32. Referring also to FIG. 17, second indicia is disposed on each of the plurality of supplemental stations 332. The symbols (suits) of diamonds, spades, diamonds, clubs, and hearts are disposed respectively upon the five supplemental stations 332.

a removable opaque coating is disposed on the first plurality of stations 224 of each lane 222 and upon the at least one supplemental station 332, the opaque coating covering the first indicia and the second indicia. The removable coating is shown applied in FIG. 16, and removed in FIG. 17.

FIG. 17 is a plan view of the scratch lottery ticket embodiment 220 with the opaque coating removed. It is noted that diamond lane 222*a* is the winning lane, and that the supplemental stations 232 contain two diamonds.

A method of playing a lottery game includes:

(a) providing a lottery scratch ticket as described in the discussion of FIGS. 16 and 17.

(b) a player removing the opaque coating from the stations 224 of one lane 222 which has each of its stations 224 filled with first indicia representing the symbol of the one lane 222. In FIG. 17, it is appreciated that the opaque coating has been removed from all of the stations 224 of each of the lanes 222.

(c) the player then removing the opaque coating from the at least one supplemental station 332. In FIG. 17, the opaque coating has been removed from all of the five supplemental stations 332.

(d) the player receives a payoff if the second indicia of any of the at least one supplemental station 232 matches the first indicia. In FIG. 17, the supplemental stations 232 include two diamond symbols, which is the symbol suit of the winning lane 222*a*. In a preferred embodiment, the payoff is a function of the number of supplemental stations 332 which contain second indicia which matches the first indicia of the winning lane. That is, the more supplemental stations 332 having symbols (suits) which match the winning lane 222, the larger the payoff.

Figure 18:
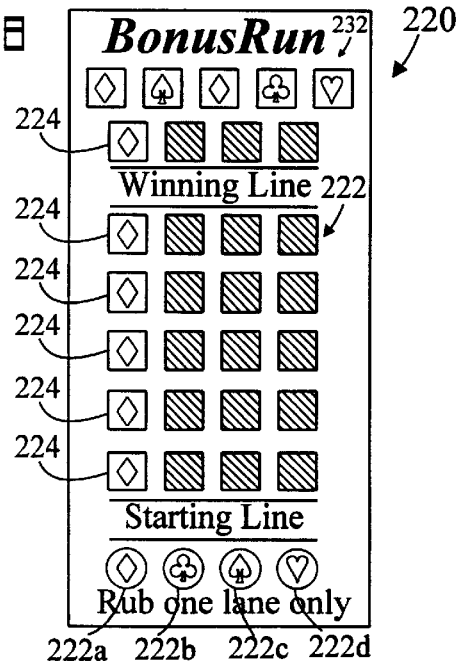

FIG. 18 is a plan view of the second scratch lottery ticket embodiment, generally designated as 320, wherein a player is only permitted to remove the opaque coating from one of the lanes. Please refer to the second method discussed below.

A second method of playing a lottery game includes:

(a) providing a lottery scratch ticket as described in the discussion of FIGS. 16 and 18.

(b) a player selecting only one lane 222 and removing the opaque coating from the stations 224 of selected lane 222.

(c) the player receiving a first payoff if the lane 222 selected in step (b) is the one lane 222 which has each of its stations 224 filled with first indicia representing the symbol (suit) of the one lane 222. In FIG. 18, the player correctly selected the winning diamond lane 222.

(d) the player removing the opaque coating from each of the at least one supplemental station 232.

(e) the player receiving a second payoff if the second indicia of any of the at least one supplemental station 232 matches the first indicia. In FIG. 18, two supplemental stations 232 match the winning diamond lane.

The preferred embodiments of the invention described herein are exemplary and numerous modifications, dimensional variations, and rearrangements can be readily envisioned to achieve an equivalent result, all of which are intended to be embraced within the scope of the appended claims.

We claim:

1. A method of playing a wagering game, comprising:

(a) providing a playing area, said playing area including;

four lanes, one lane labeled with a suit of diamonds, one lane labeled with a suit of clubs, one lane labeled with a suit of spades, and one lane labeled with a suit of hearts, each said lane including a first plurality of card-receiving stations;

at least one player wagering station, said at least one player wagering station including (1) a conventional wagering area, and (2) a supplemental wagering area; and, at least one supplemental card-receiving station;

(b) providing a deck of playing cards, said deck having equal numbers of diamond cards, club cards, spade cards, and heart cards;

(c) a dealer shuffling said deck of playing cards;

(d) said dealer dealing a card on each said supplemental card-receiving station of step (a);

(e) a player placing a conventional wager upon one of said lanes, and said player optionally placing a supplemental wager;

(f) said dealer dealing a card from said deck and placing said card on a card-receiving station of said lane which corresponds to said suit of said dealt card;

(g) repeating step (f) until all said card-receiving stations of one said lane are filled;

(h) said player receiving a conventional payoff if said conventional wager was placed on said lane whose card-receiving stations were filled in step (g); and, (i) said player receiving a supplemental payoff if said suit of any said card dealt in step (d), matches said suit of said lane filled in step (g), and said player placed a supplemental wager in step (e).

2. The method according to claim 1, further including:

in step (a), said playing area being disposed on one of a casino gaming table, a game board, a playing cloth, a video game, a playstation, a bar top game, a slot machine, a tv set, a computer monitor, a lottery scratch ticket, and a portable hand held game.

3. The method according to claim 1, further including:

in step (a), said first plurality of card-receiving stations being five.

4. The method according to claim 1, further including:

in step (a), said at least one player wagering station including a second plurality of player wagering stations.

5. The inethod according to claim 4, further including:

said second plurality of player wagering stations being seven.

6. The method according to claim 1, further including:

in step (a), said at least one supplemental card-receiving station including a third plurality of supplemental card-receiving stations.

7. The method according to claim 6, further including:

in step (i), said supplemental payoff being a function of the number of cards in said third plurality of supplemental card-receiving stations which match said suit of said lane filled in step (g).

8. The method according to claim 7, further including:

said third plurality of supplemental card-receiving stations being five.

9. The method according to claim 8, further including:

in step (i), said supplemental payoff being:

none, if no said cards in said supplemental card-receiving stations match said suit of said lane filled in step (g);

one times said supplemental wager, if one said card in said supplemental card-receiving stations matches said suit of said lane filled in step (g);

six times said supplemental wager, if two said cards in said supplemental card-receiving stations match said suit of said lane filled in step (g);

25 times said supplemental wager, if three said cards in said supplemental card-receiving stations match said suit of said lane filled in step (g);

80 times said supplemental wager, if four said cards in said supplemental card-receiving stations match said suit of said lane filled in step (g); and, 200 times said supplemental wager, if five said cards in said supplemental card-receiving stations match said suit of said lane filled in step (g).

10. The method according to claim 1, further including:

in step (e), said player placing said conventional wager on only one of said lanes.

11. The method according to claim 1, further including:

in step (h), said conventional payoff being a function of a margin of victory of said lane which is filled in step (g).

12. The method according to claim 11, further including:

in step (h), calculating the difference between said first plurality of card-receiving stations and the maximum number of card-receiving stations filled in any other said lane;

said conventional payoff being:

one times said conventional wager if said difference is one;

three times said conventional wager if said difference is two;

five times said conventional wager if said difference is three;

20 times said conventional wager if said difference is four;

60 times said conventional wager if said difference is five.

13. The method according to claim 1, further including:

step (d) being performed either before or after step (g).

14. The method according to claim 1, further including:

in step (d), said cards being dealt either face down or face up.

15. A method of playing a wagering game, comprising:

(a) providing a deck of playing cards, said deck having equal numbers of the suits of diamond cards, club cards, spade cards, and heart cards;

(b) a dealer shuffling said deck of playing cards;

(c) said dealer dealing a first predetermined number of cards;

(d) a player placing a conventional wager upon one of (1) said suit of diamonds, (2) said suit of clubs, (3) said suit of spades, and (4) said suit of hearts, and said player optionally placing a supplemental wager;

(e) said dealer sequentially dealing cards from said deck until a second predetermined number of cards of any of said suits of diamonds, clubs, spades, and hearts is reached;

(f) said player receiving a conventional payoff if said conventional wager was placed on said suit where said second predetermined number was reached in step (e); and, (g) said player receiving a supplemental payoff if said suit of any of said first predetermined number of cards match said suit where said second predetermined number was reached in step (e), and said player placed said supplemental wager in step (d).

16. The method according to claim 15, further including:

in step (c), said first predetermined number of cards being five.

17. The method according to claim 15, further including:

in step (e), said second predetermined number of cards being five.

18. The method according to claim 15, further including:

in step (d), said player placing said conventional wager on only one of said suits.

19. The method according to claim 15, further including:

in step (f), said conventional payoff being a function of a margin of victory of said suit where said second predetermined number was reached in step (e).

20. The method according to claim 15, further including:

in step (g), said supplemental payoff being a function of the number of said first predetermined number of cards which match said suit where said second predetermined number was reached in step (e).

21. The method according to claim 15, further including:

step (c) being performed either before or after step (e).

22. The method according to claim 15, further including:

in step (c), said cards being dealt either face down or face up.

23. A method of playing a wagering game, comprising:

(a) providing a playing area, said playing area including; a plurality of lanes, each said lane being labeled with a different symbol, each said lane including a first plurality of card-receiving stations;

at least one player wagering station, said at least one player wagering station including (1) a conventional wagering area, and (2) a supplemental wagering area; and, at least one supplemental card-receiving station;

(b) providing a deck of playing cards, said deck having equal numbers of cards having each of said symbols;

(c) a dealer shuffling said deck of playing cards;

(d) said dealer dealing a card on each said supplemental card-receiving station of step (a);

(e) a player placing a conventional wager upon one of said lanes, and said player optionally placing a supplemental wager;

(f) said dealer dealing a card from said deck and placing said card on a card-receiving station of said lane which corresponds to said symbol of said dealt card;

(g) repeating step (f) until all said card-receiving stations of one said lane are filled;

(h) said player receiving a conventional payoff if said conventional wager was placed on said lane whose card-receiving stations were filled in step (g);

(i) said player receiving a supplemental payoff if said symbol of any said card dealt in step (d), matches said symbol of said lane filled in step (g), and said player placed a supplemental wager in step (e).

* * * * *